US006263794B1

(12) United States Patent
Haupenthal

(10) Patent No.: US 6,263,794 B1
(45) Date of Patent: Jul. 24, 2001

(54) GRIPPER FOR A SHEET-TRANSPORTING CYLINDER OR DRUM OF A ROTARY PRINTING PRESS

(75) Inventor: Rudi Haupenthal, Epfenbach (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/348,157

(22) Filed: Jul. 6, 1999

(30) Foreign Application Priority Data

Jul. 6, 1998 (DE) ..... 198 30 080

(51) Int. Cl.[7] ..... B41F 21/04; B41F 1/30; B65H 29/06

(52) U.S. Cl. ..... 101/409; 101/246; 271/277; 271/82

(58) Field of Search ..... 101/408, 409, 101/415.1, 246, 410; 271/268, 277, 204, 205, 82, 85

(56) References Cited

U.S. PATENT DOCUMENTS

| | | | | |
|---|---|---|---|---|
| 3,824,928 | * | 7/1974 | Langer | 101/145.1 |
| 4,101,122 | | 7/1978 | Jeschke et al. . | |
| 4,253,396 | * | 3/1981 | Wieland | 101/409 |
| 4,781,370 | | 11/1988 | Weisgerber . | |
| 4,846,061 | * | 7/1989 | Jeschke et al. | 101/409 |
| 5,199,757 | * | 4/1993 | Simeth | 101/409 |
| 5,303,650 | * | 4/1994 | Wieland | 101/409 |
| 5,542,657 | * | 8/1996 | Kemmerer et al. | 271/82 |

FOREIGN PATENT DOCUMENTS

| | | |
|---|---|---|
| 488 948 | 12/1929 | (DE) . |
| 24 14 998 A1 | 10/1975 | (DE) . |
| 28 22 049 B2 | 5/1980 | (DE) . |
| 36 23 405 A1 | 2/1988 | (DE) . |
| 35 19 293 C2 | 4/1989 | (DE) . |
| 42 14 191 A1 | 11/1993 | (DE) . |
| 43 07 712 C1 | 2/1994 | (DE) . |
| 43 30 610 A1 | 3/1995 | (DE) . |
| 0 643 001 B1 | 5/1996 | (EP) . |

* cited by examiner

*Primary Examiner*—John S. Hilten
*Assistant Examiner*—Leslie J. Grohusky
(74) *Attorney, Agent, or Firm*—Herbert L. Lerner; Laurence A. Greenberg; Werner H. Stemer

(57) ABSTRACT

A gripper for a cylinder or a drum of a sheet-fed rotary printing press, includes a gripper element adjustable relative to a gripper shaft carrying the gripper, the gripper element being disposed so as to be swivellable about a swivel point thereon for effecting an adjustment, the gripper element being formed with a concavely curved seating surface having a radius adapted to and smaller than the radius of the gripper shaft.

8 Claims, 3 Drawing Sheets

Fig.1
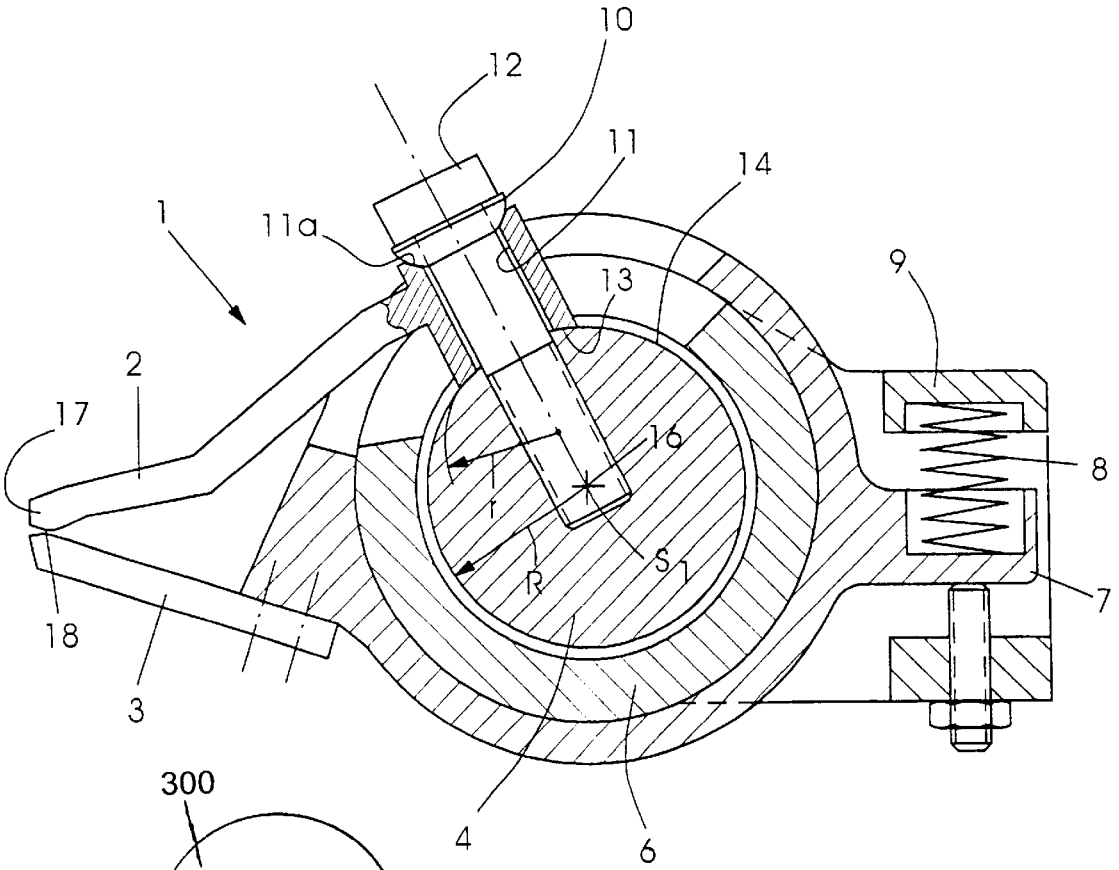
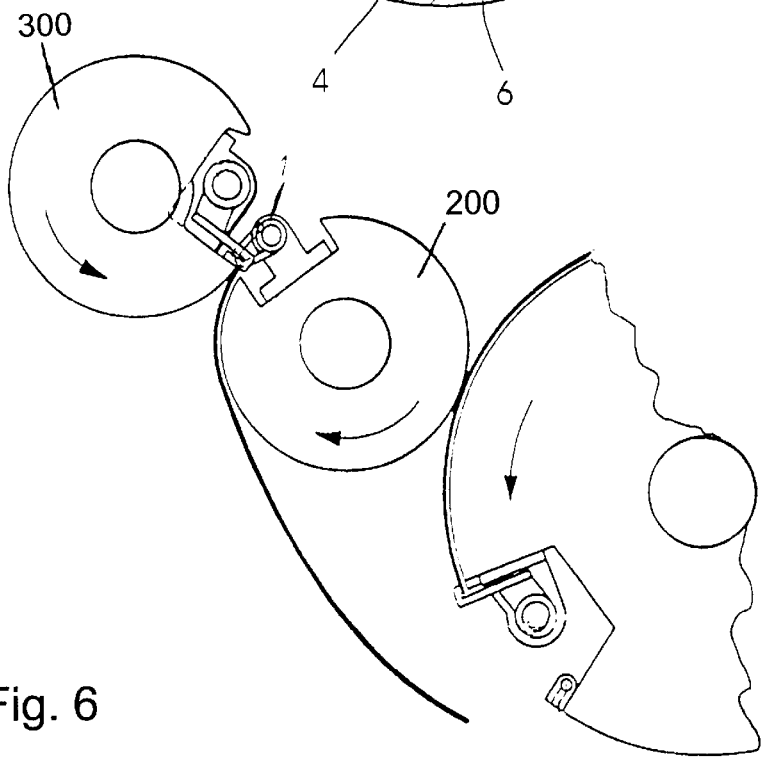
Fig. 6

GRIPPER FOR A SHEET-TRANSPORTING CYLINDER OR DRUM OF A ROTARY PRINTING PRESS

BACKGROUND OF THE INVENTION

Field of the Invention

The invention relates to a gripper on a sheet-transporting cylinder of a rotary printing press, in particular a pincers gripper on a reversing drum.

The published German Patent Document DE 24 14 998 A1 describes a so-called pincers gripper formed of a gripper member and a counter-gripper member. In this regard, the gripper member forms a gripper seat and the counter-gripper member forms a swivellable gripper finger disposed opposite the gripper seat. A number of these pincers grippers are distributed at intervals along the axial length of the sheet-transporting cylinder. The gripper seats are screwed to a common gripper shaft. For this purpose, the gripper shaft, at least in the region wherein the gripper seats are fixed, has a flat surface on which, during the mounting of the gripper seats, the latter can be fixed while allowing them to be displaced linearly in order to eliminate manufacturing tolerances. During the adjustment of the gripper seats, a problem exists that all of the clamping locations of the adjacently arranged gripper seats and the respective gripper fingers should lie on a common line of the clamping locations in order that the sheet to be transported can be gripped evenly without the formation of waves or undulations therein.

Due to a linear displacement of the gripper seats as in the published German Patent Document DE 24 14 998 A1, however, it becomes very difficult to set a common line for all adjacently arranged gripper devices, so that small tolerances must be accepted. Particularly for pincers grippers which transport the sheets in both recto or first-form printing, and in verso or perfector printing positions differing by more than 180°, the deviations of the clamping locations from the common line of clamping locations (the ideal line) are doubled.

SUMMARY OF THE INVENTION

It is accordingly an object of the invention to provide a gripper with a gripper element of the gripper that is adjustable so as to minimize a deviation of clamping locations thereof from a common ideal line.

With the foregoing and other objects in view, there is provided, in accordance with one aspect of the invention, a gripper for a cylinder or a drum of a sheet-fed rotary printing press, the gripper comprising a gripper element adjustable relative to a gripper shaft carrying the gripper, the gripper element being disposed so as to be swivellable about a swivel point thereon for effecting an adjustment, the gripper element being formed with a concavely curved seating surface having a radius adapted to and smaller than the radius of the gripper shaft.

In accordance with another feature of the invention, the swivel point is disposed on or within the periphery of the gripper shaft.

In accordance with a further feature of the invention, the gripper shaft has an axis, and the swivel point is on the axis of the gripper shaft.

In accordance with an added feature of the invention, the gripper element is formed with a bore through which there extends a fixing member with adjustment play.

In accordance with an additional feature of the invention, the gripper element is cooperatively engageable with a counter-gripper element so disposed on a gripper tube coaxially surrounding the gripper shaft as to permit the counter-gripper element to swivel.

In accordance with yet another feature of the invention, the ripper includes a spring element for bracing the counter-gripper element and the gripper element cooperatively engageable therewith against one another.

In accordance with yet a further aspect of the invention, there is provided a gripper for a cylinder or a drum of a sheet-fed rotary printing press, the gripper comprising a gripper element adjustable relative to a gripper shaft carrying the gripper, the gripper element being disposed on a flat seating surface formed on the gripper shaft and being adjustable about a swivel point on the gripper element.

In accordance with a concomitant feature of the invention, the gripper element is a gripper seat, and the counter-gripper element is a gripper finger.

The invention thus offers the advantage that the quality of the take-over and feeding of the sheets to be transported can be improved in both the recto or first-form and the verso or perfector settings. A further advantage is that assembly times can be considerably reduced by a simpler method of adjusting the gripper elements.

The resistance of the shaft towards twisting and bending does not need to be reduced by recesses for mounting the gripper seat.

In a preferred embodiment of the invention, a swivelling point for the gripper elements is disposed on the axis of the gripper shaft. This feature enables the clamping points of the gripper device to be adjusted on a common ideal line.

In an advantageous embodiment, a fixing surface of the gripper seat is formed with a concave curvature having a radius of curvature smaller than the radius of the gripper shaft. This feature prevents the gripper seat from swivelling, e.g. in the screw direction, while it is fixed to the gripper shaft, i.e., the clamping line of a gripper seat, after the screw has been tightened, is aligned parallel to the gripper shaft and axis, respectively, without any further adjustment measures.

The fixing or fastening surfaces may be very rough, due to which the clamping seat on the shaft is improved. An undesired release of the gripper seat from the gripper shaft is thereby prevented.

Other features which are considered as characteristic for the invention are set forth in the appended claims.

Although the invention is illustrated and described herein as embodied in a gripper for a sheet-transporting cylinder or drum of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 1 is a diagrammatic cross-sectional view of a first embodiment of the gripper according to the invention;

FIG. 6 is a diagrammatic side elevational view of part of a sheet-fed rotary printing press showing two drums or cylinders of a sheet reversing device, namely an upline reversing drum or cylinder and a drum or cylinder downline therefrom, the reversing drum being provided with a plurality of the grippers according to the invention.

DESCRIPTION OF THE PREFERRED EMBODIMENTS

Figure 2:
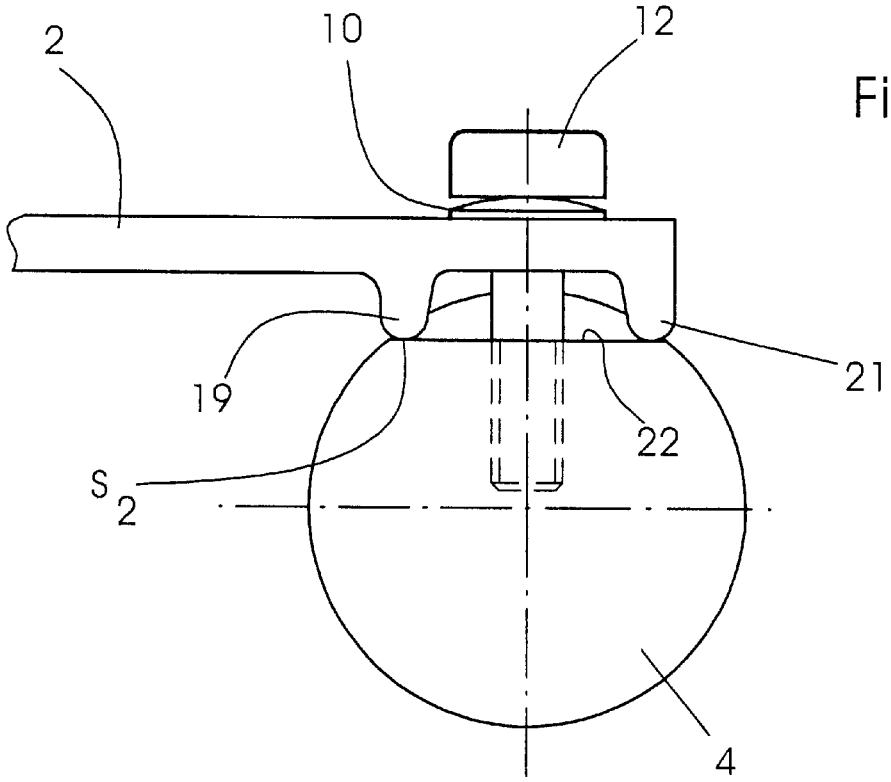
FIGS. 2 to 5 are respective fragmentary diagrammatic side elevational views of FIG. 1 showing a second, third, fourth and fifth embodiment, respectively, of the gripper.

Referring now to the drawings and, first, particularly, to FIG. 6 thereof, there is shown therein part of a sheet-fed rotary printing press having a reversing drum or cylinder 200 for transporting sheets to be printed or sheets which have already been printed in a recto or first-form printing operation, respectively, i.e., the sheet is taken over at a leading edge thereof by a so-called pincers gripper 1 according to the invention carried by the reversing cylinder 200, and transferred at the leading edge to a gripper device of a cylinder 300 downline from the thus upline reversing cylinder 200; as well as in a verso or perfector printing operation, i.e., the sheets are taken over at the trailing edge thereof by the upline cylinder 200 and reversed or turned before being transferred, with the trailing edge thereof leading, to the downline cylinder 300.

In the first embodiment shown in FIG. 1, a so-called pincers gripper 1 is provided. The pincers gripper 1 has a first pincer 2 which serves as a pincer seat, and a second pincer 3 which operates together with the gripper seat 2 and is formed as a gripper finger.

A large number, such as twenty, for example, pincers grippers 1 are distributed at spaced intervals from one another along the axial length of the transport or reversing drum 200, the gripper seats 2 thereof being firmly fixed to a common gripper shaft 4, and the gripper fingers 3 of the pincers grippers 1 being supported on a common gripper tube 6 so as to be swivellable about the gripper shaft 4. The gripper fingers 3 are braced respectively by a stop 7 via a compression spring 8 against a restraint 9 fixed solidly to the gripper tube 6. The gripper seats 2, respectively, are formed with a bore 11 at an end thereof facing away from the tip 17 of the gripper seats 2, the bore 11 having a diameter somewhat larger than a fixing or fastening screw 12 for securing the gripper seat 2, so that an adjustment of the gripper seat 2 relative to the gripper shaft 4 is possible, especially during assembly.

At an upper end of the bore 11, a spherical seat 11*a* is formed wherein a spherical sealing washer 10 is disposed for providing positional compensation for the fixing screw 12 and the gripper seat 2.

The gripper seat 2 has a concave-shaped, rough, e.g., sand-blasted, seating surface 13 that matches the curvature 14 of the circumference of the gripper shaft 4. The curvature of the seating surface 13 preferably has a smaller radius r than the radius R of the circumference of the gripper shaft 4. Due to this feature, the gripper seat 2 sits beforehand, while yet in unfastened condition, on the gripper shaft 4, during assembly, with a double linear contact parallel to the axis 16. The gripper seat 2 requires alignment only in the axial and the circumferential direction of the gripper shaft 4. Upon tightening the fixing screw 12, the seating surface 13 is pressed under tension against the circumference of the gripper shaft 4. Consequently and in accordance with the invention, any possibility that the gripper seat 2 might become skewed or inclined while it is being tightly screwed to the gripper shaft 4, e.g., due to the applied torque, is avoided.

All of the gripper seats 2 are adjusted on the radius R about the axis 16 of the gripper shaft 4. In this regard, the axis 16 forms a swivelling point $S_1$ for the circumferential alignment of the gripper seat 2. Ideally, all gripper seat tips 17 arranged axially adjacent to one another should lie on a common clamping-point line 18 parallel to the gripper shaft 4 and the axis 16, respectively.

In a second embodiment of the pincers gripper according to the invention, as shown in FIG. 2, the gripper seat 2 is provided with two supports 19 and 21 at the end thereof facing away from the gripper seat tip 17, the supports 19 and 21 being braced against a flat or planar supporting surface 22 of the gripper shaft 4 in the embodiment of FIG. 2. The supporting surface 22 may, however, also be formed with a curvature without impairing the function thereof. The fixing screw 12 sits in a bore formed in the gripper shaft 4 in a somewhat middle position between the two supports 19 and 21 and clamps the gripper seat 2 and the gripper shaft 4 together. When the fixing screw 12 is tightened with a torque that exceeds a specific value, the gripper seat tip 17 swivels about a swivelling point $S_2$ that lies on or within the periphery of the gripper shaft 4.

Figure 3:
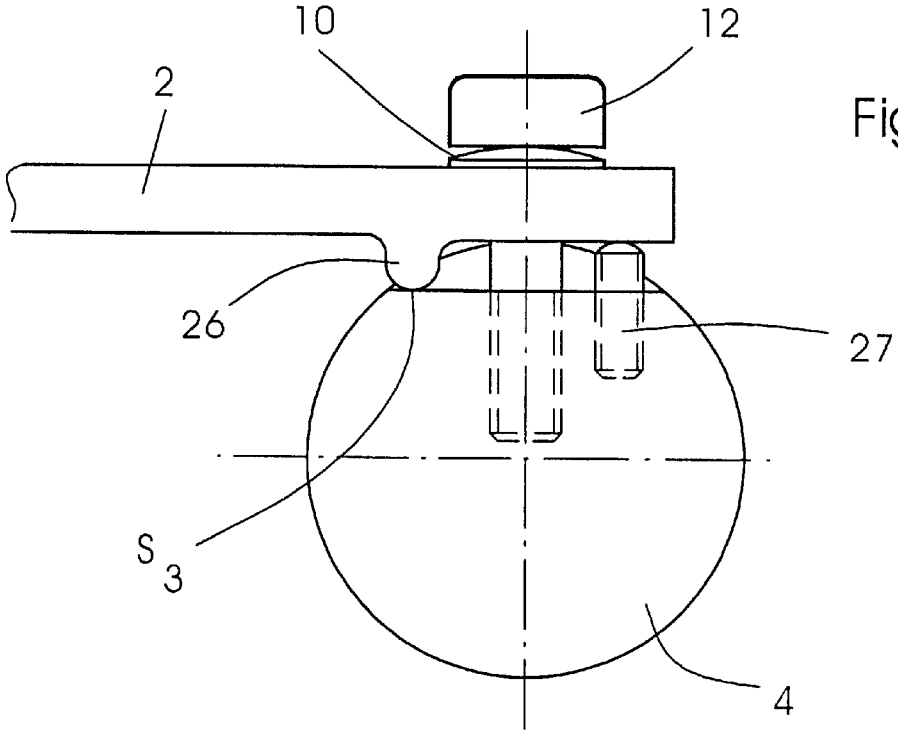

In a third embodiment of the pincers gripper according to FIG. 3, the gripper seat 2 is formed as a rocker rocking about a first support 26. An adjusting screw 27 at the end of the gripper seat 2 swivels the gripper seat 2 about a swivel point $S_3$. The latter lies within the periphery of the gripper shaft 4.

Figure 4:
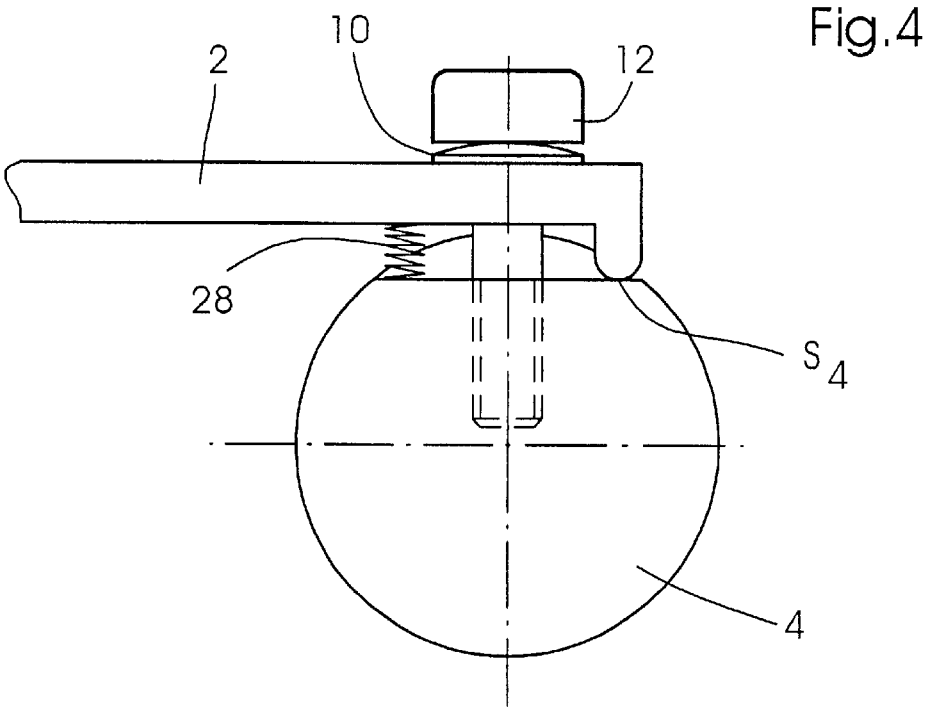
Figure 5:
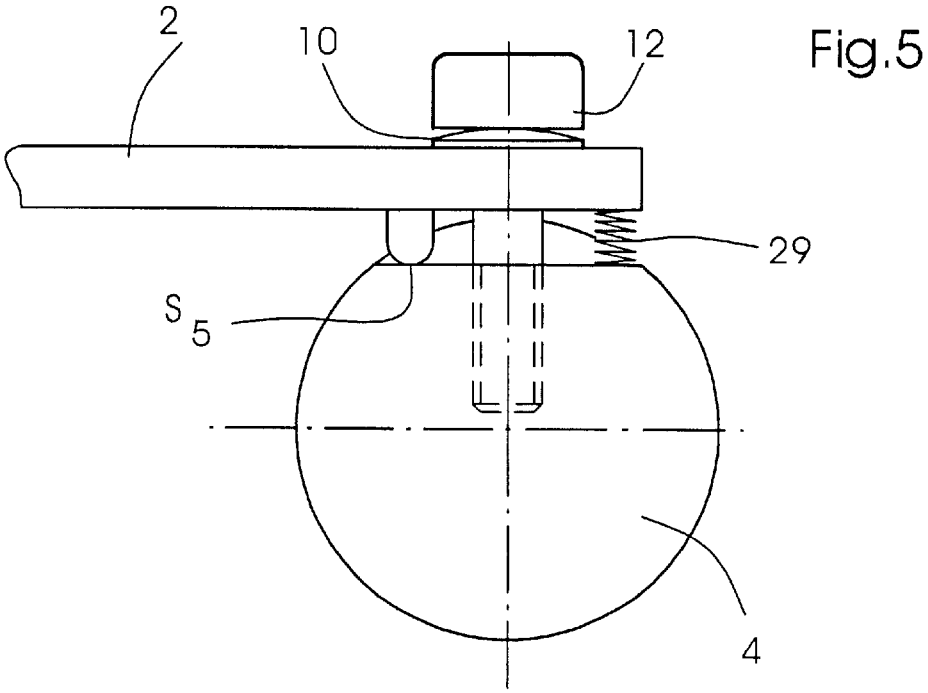

In fourth and fifth embodiments of the pincers gripper shown in FIGS. 4 and 5, respectively, one of the supports 19 and 21 is formed as a spring element 28, 29. Thus, in the fourth embodiment shown in FIG. 4, the gripper seat 2 can be adjusted against the spring element 28 about a swivel point $S_4$.

With the fifth embodiment according to FIG. 5, there is provided an adjustment of the gripper seat 2 against the spring element 29 about a swivel point $S_5$.

In regard to the foregoing, the swivel points $S_4$ and $S_5$ lie within the periphery of the gripper shaft 4.

As in the first embodiment of FIG. 1, for positionally compensating the fixing screw 12 and the gripper seat 2, a spherical sealing washer 10 is also fitted between the head of the fixing screw 12 and the gripper seat 2 in the second to fifth embodiments of the pincers gripper according to FIGS. 2 to 5, respectively.

I claim:

1. A gripper for a cylinder or a drum of a sheet-fed rotary printing press, the gripper comprising:

a gripper shaft having an axis and a cylindrical circumferential surface with a constant gripper shaft radius;

a pincers gripper mounted on said gripper shaft, formed with a concavely curved seating surface having a smaller seating surface radius than said gripper shaft radius, wherein the gripper seating surface sits directly on the cylindrical circumferential surface of the shaft; and a swivel point located at said axis of said gripper shaft for adjusting said gripper shaft relative to said pincers gripper by allowing swiveling of said pincers gripper about said swivel point.

2. The gripper according to claim 1, wherein said swivel point is disposed on or within the periphery of the gripper shaft.

3. The gripper according to claim 1, wherein said swivel point is on said axis of said gripper shaft.

4. The gripper according to claim 1, wherein said pincers gripper is formed with a bore through which there extends a fixing device with adjustment play.

5. The gripper according to claim 1, wherein said pincers gripper is cooperatively engageable with a counter-gripper element so disposed on a gripper tube coaxially surrounding the gripper shaft as to permit the counter-gripper element to swivel.

6. The gripper according to claim 5, including a spring element for bracing said counter-gripper element and said pincers gripper cooperatively engageable therewith against one another.

7. The gripper according to claim 5, wherein said pincers gripper is a gripper seat, and said counter-gripper element is a gripper finger.

8. A gripper for a cylinder or a drum of a sheet-fed rotary printing press, the gripper comprising:

a gripper shaft including a flat seating surface;

a pincers gripper disposed on said flat seating surface, said pincers gripper having a first support on a lower surface of the pincers gripper thereof;

a fixing screw fastening said pincers gripper to said gripper shaft; and a swivel point separate from said fixing screw located at an intersection of said first support of said pincers gripper and said gripper shaft for adjusting said gripper shaft relative to said pincers gripper by allowing an entirety of said pincers gripper to rotate about said swivel point.

* * * * *